US007192059B2

(12) United States Patent
Guyon et al.

(10) Patent No.: US 7,192,059 B2
(45) Date of Patent: Mar. 20, 2007

(54) IN-LINE SKATE GUARD

(75) Inventors: Andrea Louise Guyon, Victoria (CA); Louis Mathew Dubravich, Kamloops (CA)

(73) Assignee: Andad Research and Development Inc., Victoria, B.C. (CA)

( * ) Notice: Subject to any disclaimer, the term of this patent is extended or adjusted under 35 U.S.C. 154(b) by 187 days.

(21) Appl. No.: 10/705,840

(22) Filed: Nov. 13, 2003

(65) Prior Publication Data

US 2004/0140661 A1 Jul. 22, 2004

Related U.S. Application Data

(60) Provisional application No. 60/426,357, filed on Nov. 15, 2002.

(51) Int. Cl.
*A63C 17/20* (2006.01)

(52) U.S. Cl. ..... 280/825

(58) Field of Classification Search ..... 280/809, 280/811, 816, 825; 36/25 R, 136
See application file for complete search history.

(56) References Cited

U.S. PATENT DOCUMENTS 3,965,586 A * 6/1976 Roosli ..... 36/7.3
4,811,504 A * 3/1989 Bunke ..... 36/132
5,522,621 A * 6/1996 Schneider ..... 280/825
5,573,275 A * 11/1996 Smith et al. ..... 280/825
5,988,682 A * 11/1999 Allera ..... 280/825
6,079,747 A * 6/2000 Winsor ..... 280/825
6,260,289 B1 * 7/2001 Tsuji ..... 36/103
6,916,046 B2 * 7/2005 Riley et al. ..... 280/825

FOREIGN PATENT DOCUMENTS

DE 33 06 516 A1 * 8/1984
DE 296 15 917 U1 * 1/1997
DE 297 10 633 U1 * 5/1998

* cited by examiner

*Primary Examiner*—Frank Vanaman
(74) *Attorney, Agent, or Firm*—J. Gordon Thomson

(57) ABSTRACT

An in line skate guard for fastening to an in line skate having a plurality of serially mounted rollers that permits the wearer to walk safety using a natural human walking gait cycle. The in line skate guard has an elongate body having a bottom surface comprising a plurality of integral contact planes in a serial and contiguous relationship. These contact planes include a first, second, third, fourth and fifth contact planes each one of which is adapted to promote the natural human walking gate cycle. The elongate body is held onto the plurality of rollers by a deep groove that engages the roller wheels in a pinching relationship. There are also semi circular hoops that engage the front and rear of the in line skate rollers. Tension chords are also used to fasten the elongate body to the skate frame. The in line skate guard comprises a front portion, a middle portion and a rear portion and may be molded using a family of molds with the front portion mold and the rear portion mold fixed for all lengths of the in line skate guard and the middle portion is variable to accommodate differing lengths of the skate guard.

15 Claims, 19 Drawing Sheets

IN-LINE SKATE GUARD

CROSS-REFERENCE TO RELATED APPLICATIONS

This application is entitled to the benefit of U.S. Provisional Patent Application # 60/426,357 filed in the United States Patent Office on Nov. 15, 2002.

BACKGROUND OF THE INVENTION

1. Field of the Invention

This invention relates to the field of ski or skate appliance or attachment, more particularly, scabbards for ice and roller skates and specifically for an improved in-line skate guard.

2. Discussion of the Prior Art

In line skating is a popular past-time and, unlike ice skating, in line skating is not restricted to an arena. In line skating can take place on any relatively flat and smooth surface such as a road or side walk and very large distances can be covered by an in-line skater. After completing a skating session or upon arriving at a destination, an in line skater may wish to enter a store, climb stairs or use public transportation while still wearing the in line skates rather than remove them and dawning walking shoes. This need to walk and/or climb stairs rather than skate in certain locations creates a problem for the in line skater because there is generally no way to fix the rollers in a stationary configuration so that they do not rotate when the skater attempts to walk. Further, even if fixed, the rollers do not provide a stable surface upon which to bear the weight of the wearer or upon which to walk in a safe fashion. Attempting to walk while wearing a pair of in line skates with free-wheeling rollers presents well known hazards in restricted or crowed spaces such a retail outlets or on public transportation conveyances. Indeed, many stores and public transportation organizations have banned the wearing of in line skates on their premises. Various solutions to this problem have been attempted to provide a stable platform for the wearer of in line skates so that they may walk in areas where skating is awkward or prohibited. The prior art is exemplified by U.S. Pat. No. 5,573,275 entitled "In-Line Skate Guard" issued to Smith and Hardie on Nov. 12, 1996 shown in the figure labeled as "Prior Art". Smith and Hardie disclose a guard for use on in-line skates comprising a rigid main body with wheel receiving troughs that are slightly wider than the wheels they receive. While this guard is adequate to permit the wearer to ambulate over a short distances, the wearer's leg movements must be piston-like so that the base of the guard is maintained horizontal. This creates a significant amount of stress on the leg and in particular on the patella ligaments supporting the knee cap. Furthermore, a design such as disclosed in Smith and Hardie is not well adapted to climbing or descending stairs or inclined surfaces. For example, an impact upon the heel of the Smith and Hardie guard may result in rotation of the rollers, dislodgement of the skate guard and injury to the wearer. Therefore, the prior art discloses only a partial solution to the problem of walking while wearing in line roller skates in that it is not adapted to the human walking gait cycle. Hence, there continues to be a need for an in line skate guard that permits a natural walking gait cycle so that the wearer of a pair of in line skates can walk comfortably and safely.

OBJECTS OF THE INVENTION

In light of the disadvantages noted above, it is a principle object of the present invention to provide an improved skate guard that permits the wearer to adopt a natural walking gait cycle to allow greater access and maneuverability.

Another object of the invention is to provide for an in line skate guard that prevents roller movement when the wearer is walking.

Another object of the invention is to provide an in line skate guard that permits the wearer to walk naturally over relatively long distances.

Another objective of the invention is to provide an in line skate guard that permits the wearer to climb and descent inclined surfaces and in particular stairs.

Another object of the invention is to provide for an in line skate guard that is easy to use, fix to the in line skate and transport while the in line skater is skating.

A further objective of the invention is to provide for an in line skate guard that is inexpensive to manufacture.

Still further objects and advantages to our invention will become apparent from a consideration of the ensuing description and drawings.

SUMMARY OF THE INVENTION

Our invention is an in line skate guard for an in line skate. A typical in line skate comprises a boot and a frame. The frame carries a plurality of serially mounted rollers. Typically, each of the rollers has a width between their side walls and a rounded rolling surface at their outside ends. A typical in line skate will also include a brake spur on one of the skates, usually the right one.

Our invention has an elongate body with a front portion having a first width and opposite and parallel first and second lugs projecting upwards. Our invention also includes a middle portion that has a second width and a rear portion that has a third width that is wider than the first width of the front portion to accommodate the brake spur. The middle portion has a width equal to the width of the front portion. The rear portion also includes opposite and parallel third and fourth lugs projecting upwards. The middle portion also has a groove. Within the groove there is a groove first width and a groove second width.

Our invention has a bottom surface adapted for purchase on a walking or contact surface. The bottom surface comprises a first contact plane having an angle of approximately 45 degrees to the contact surface; a second contact plane having a slightly elevated angle above the contact surface; a third horizontal contact plane; a fourth contact plane having a slightly elevated angle above the contact surface; and, a fifth contact plane having an angle of approximately 45 degrees to the contact surface. The bottom surface of the body may have a textured pattern or tread to improve purchase and traction on the walking surface.

The first and second opposite and parallel lugs define a gap. Similarly, on the back portion, the third and fourth lugs define another gap adapted to receive the brake spur. The contours of the front and rear lugs act as guides to permit the wearer to jamb the skate guards onto the stake from any angle without having to resort to a toe-first insertion.

The groove in the upper surface of the elongate body of our invention is further defined by a first wall having a top surface, an inside surface and an outside surface, and a second wall having a top surface, an inside surface and an outside surface. The first wall and the second wall are adapted to flex outwards when the rollers are inserted between them. Consequently, the rollers are held in a pinching relationship within the groove.

The groove in the elongate body of our invention further includes a bottom surface adapted to engage the contact surface of each of the rollers. The groove has a groove first width that is adapted to receive the width of the rollers and hold them in a pinching relationship. The groove has a groove second width that is narrower than the groove first width. Between the groove first and groove second widths there is a beveled portion adapted to receive and hold in a pinching relationship the rounded rolling surface of each of the rollers. The groove further includes a front curvilinear bight and a rear curvilinear bight. The groove is deep enough so that when the in line skate guard is fastened to the in line skate, the top surface of the walls of the groove abut the bottom surface of the frame.

Within each of the lugs there is an aperture having a countersunk portion on their inside walls. Each of the apertures contains a sleeve.

Between the opposite and parallel lugs there are mounted semi-circular pivot hoops used to mount the elongate body to the skate. Tension chords are also used to fasten the elongate body of the in line skate guard to the in line skate. Each tension chord has an eye ring fixed to one end and a clip fixed to its opposite end. The eye ring of each tension chord is engaged in a sliding relationship with the hoops.

Our invention permits the wearer of an in line skate to walk normally using a natural human walking gait cycle. The natural human walking gait cycle comprises a heel strike phase, a transition phase from the heel strike phase to a foot flat phase, a foot flat phase, a transition phase between the foot flat phase and the heel off phase, a heel off phase and a toe off phase. Therefore, the in line skate guard of our invention comprises an elongate body having a bottom surface comprising a first contact plane adapted to contact the walking surface during the heel strike phase; a second contact plane adapted to contact the walking surface during said transition phase between the foot flat phase and the heel off phase; a third contact plane adapted to contact the walking surface during the foot flat phase; a fourth contact plane adapted to contact the walking surface during the transition phase between the foot flat phase and the toe off phase; and, a fifth contact surface adapted to contact the walking surface during the toe off phase. The first and fifth contact planes are raised approximately 45 degrees from the horizontal. The second and fourth contact planes are slightly elevated above the horizontal.

Our invention is also made from a family mold process comprising the following steps: making a first mold adapted to the shape of the front portion wherein the shape of the front portion is fixed; making a second mold adapted to the shape of the rear portion wherein the shape of the rear front portion is fixed; making a third mold adapted to the shape of the middle portion wherein the shape of the middle portion is variable to accommodate the variable lengths of serially mounted rollers; joining the first, second and third molds to make a complete mold of the elongate body; and, injecting suitable mold material into the mold.

BRIEF DESCRIPTION OF THE DRAWINGS

The foregoing and other objects, features and advantages of the invention will be apparent from the following more particular description of the preferred embodiments of the invention as illustrated in the accompanying drawings in which like reference characters refer to the same parts throughout the different views. The drawings are not necessary to scale, emphasis instead being placed upon illustrating the principles of the invention.

PRIOR ART: This is a view of a prior art in line skate.

DETAILED DESCRIPTION OF PREFERRED EMBODIMENTS

Introduction

The Human Walking Gait

Figure 1:
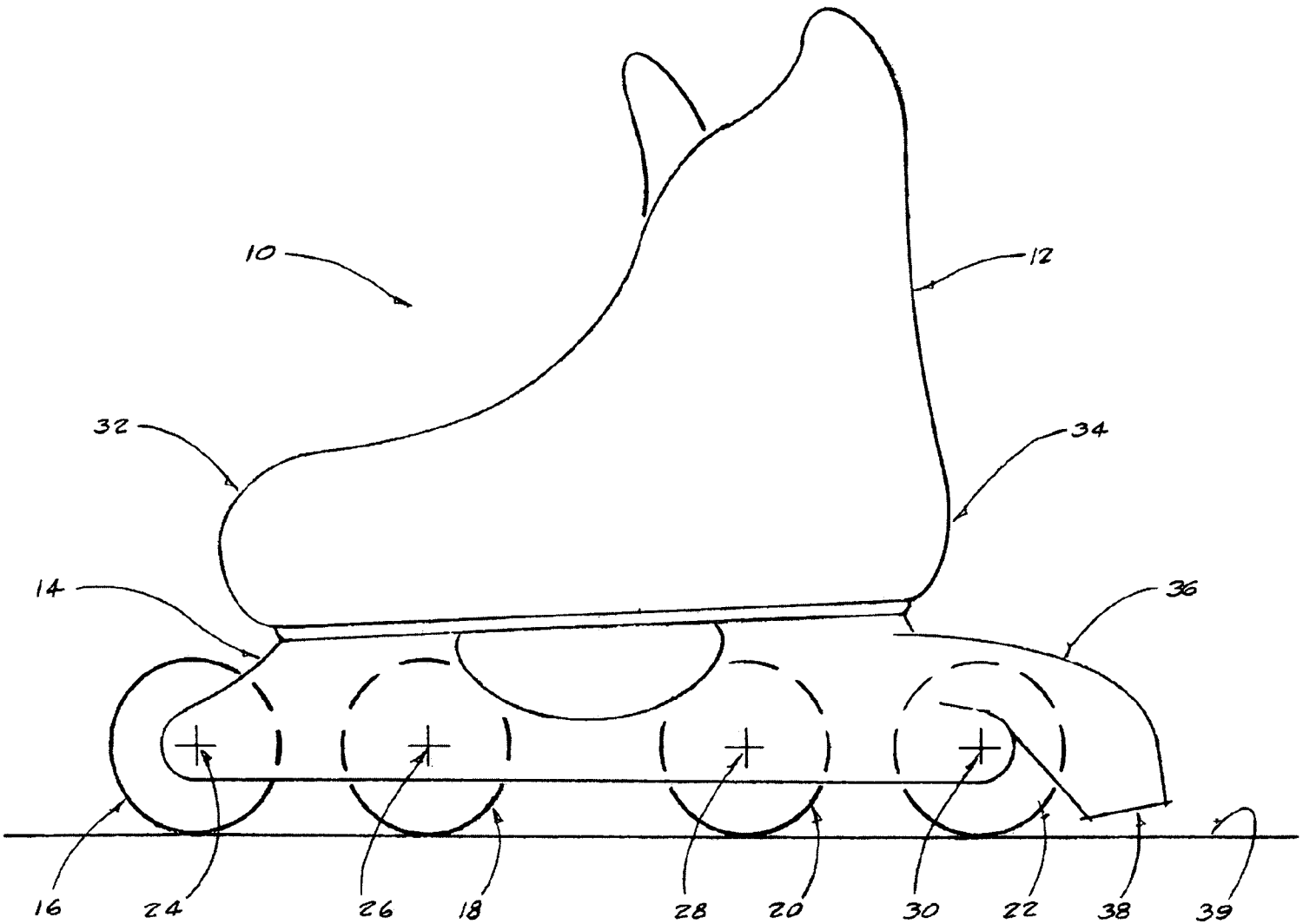
FIG. 1 is a side view of a typical in line skate.

Prior to describing our invention in detail, it is important to have some understanding of the anatomy of the foot and the nature of the walking process. The foot has two vital functions. The first function is to support the weight of the body while a person is standing or walking. The second function is to act as a lever to propel the body forward. The ankle joint allows the vertical excursion of the foot necessary for walking. Strong ligaments on each side of the ankle joint provide support and limit movement as needed.

The human walking gait cycle has the following characteristics:

The centre of mass of the body moves in a vertical plane during the gait cycle;

Horizontal body displacements occur with each rotatory movement of the pelvis as a leg advances;

Lateral body displacements occur as the body is shifted slightly over the weight bearing limb with each step; and, The total lateral displacement of the body is approximately five centimeters from side to side with each gait cycle.

The human walking gait cycle is divided into two repeating phases. The first phase is the stance phase. The stance phase comprises about 62% of the gait cycle and is the phase during which the weight of the body is supported by both limbs. The second phase is the swing phase during which the body advances and comprises about 38% of the gait cycle.

The weight bearing or stance phase comprises a series of steps or phases:

The initial heel strike phase, then proceeding to;

A transition phase between the heel strike phase and the flat foot phase;

The flat foot phase, then proceeding to;

A transition phase between the flat foot phase and the heel off phase;

The heel off phase, the proceeding to;

The toe off phase.

These phases are repetitive and never changing.

Our Invention

Our invention is an in line skate guard that has been designed with the biomechanical attributes of the human walking gait cycle in mind. As will be fully explained below, our invention incorporates novel and inventive features that permit the in line skater to walk with a normal gait, climb or descend inclined surfaces, mount and descend stairs and even run over short distances safely and without stressing the anatomy of the ankle or knee.

The Prior Art

Referring to the figure labeled "Prior Art", there is shown an in line skate guard. This prior art skate guard does not permit the wearing to walk with a natural walking gait. In particular, this device is not adapted to bear the forces from the heel strike phase of walking. For that reason, the wearer of the prior art device must ambulate by lifting legs up and down in a piston type movement rather than the natural two phase stride described above. This creates strain on the anatomy of the wearer. Furthermore, attempting to walk in a natural manner while wearing this device could result in the heel strike dislodging the guard body from the roller wheels and potentially causing an accident. Further the trough does not support the skate boot in a sufficient manner that would permit the wearer to walk or climb and descend stairs without potentially dislodging the rollers from the guard.

As fully described below, our invention provides novel and inventive improvements over the prior art that permit the wearer of our in line skate guard to walk naturally.

A Typical In Line Skate Structure

Referring to FIG. 1, there is shown a typical in line skate structure (10). The in line skate comprises a boot (12) mounted to which is a frame (14). The frame (14) is adapted to accept and hold in a rotational relationship a plurality of rollers (16 to 22). Each of the rollers (16 to 22) is mounted to the frame (14) by axles (24 to 30). The boot (12) has a toe portion (32) and a heel portion (34). Extending from heel portion (34) is a spur (36) to which is mounted a rubber projection (38) adapted to act as brake when frictionally engaged with the surface (39) upon which the skater is skating. There is usually only one brake spur on a pair of skates and this is usually on the right skate.

Figure 2:
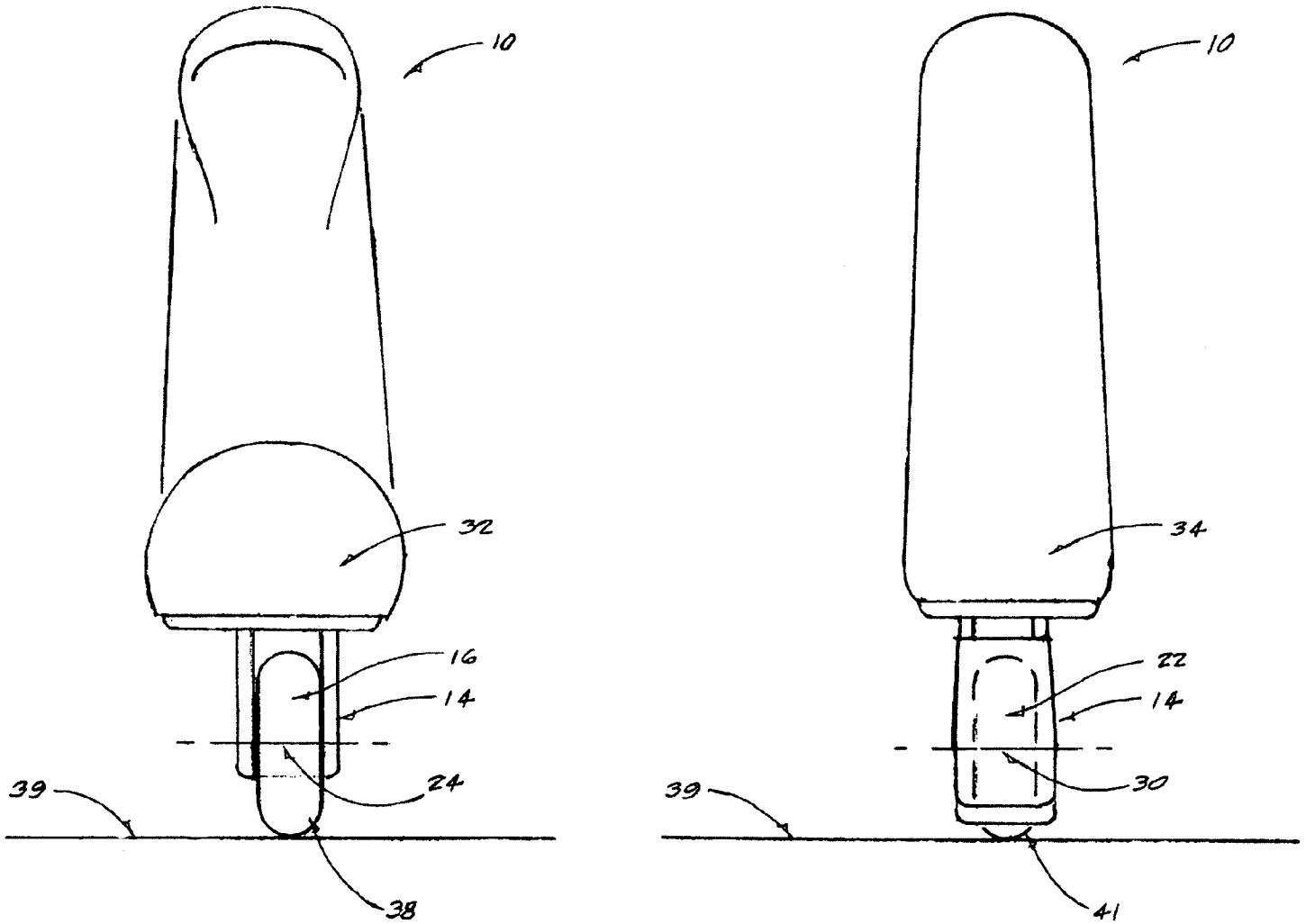
FIG. 2 is a front (toe) and rear (heel) view of the same in line skate of FIG. 1.

Referring to FIG. 2, there is shown a front or toe view and a rear or heel view of the in line skate (10). First roller (16) is mounted to frame (14) by way of axle (24). First roller (16) has a rounded rolling surface (38) for contacting skating surface (39). Similarly, last roller (22) is mounted to frame (14) by axle (30). Roller (22) has a rounded rolling surface (41) for contact with the skating surface (41).

Detailed Description of the Physical Structure of Our Invention

General Description

Figure 3:
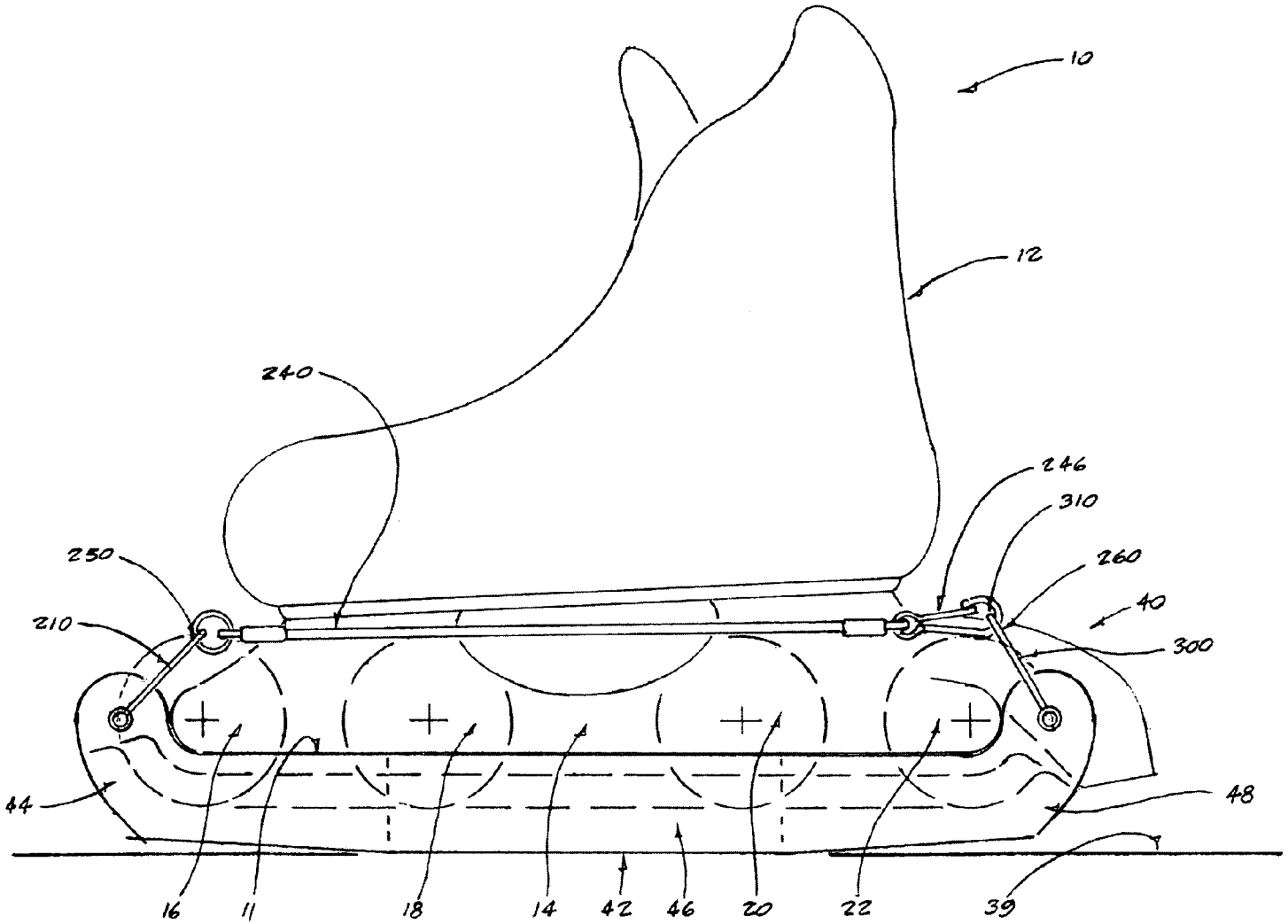
FIG. 3 is a side view of a typical in line skate with our invention fixed thereto.

Referring now to FIG. 3, there is shown our invention installed on an in line skate. The embodiment shown is for wearing on the skate with the skate brake, the right skate. A person skilled in the art will realize that our invention is sold in pairs and that the skate guard is adopted to be worn on either skate.

Our invention (40) is an in line skate guard for an in line skate (10) comprising a boot (12) and a frame (14) mounting rollers (16 to 22). Our invention comprises an elongate body (42) having a front portion (44) (illustrated in FIG. 4), a mid portion (46) (illustrated in FIG. 6) and a rear portion (48) (illustrated in FIG. 5). Each of these portions may be made into a separate mold and then assembled into a single mold. This is termed a family mold. Using the family mold manufacturing method, the front portion (44) and the rear portion (48) are consistent for all variants of our in line skate guard manufactured. However, the mid portion (46) is by necessity variable to accommodate differing lengths of boot as well as more or fewer rollers. Therefore, our invention has the advantage of being able to accommodate these variations by joining the non-varying front portion and rear portion molds with a variable mid portion mold. It is further to be understood that there are no joint lines between the front portion, mid portion and rear portion of our invention even though they might be suggested in the drawings. All three portions are integral to each other as would be expected in an injection molding process. Our invention is a single piece in line skate guard made from a suitable non-marking, non-slip and resilient compound having an elastic ability to absorb shock caused by walking. Such a compound must also be suitable for hot injection molding.

The Front Portion

Figure 4:
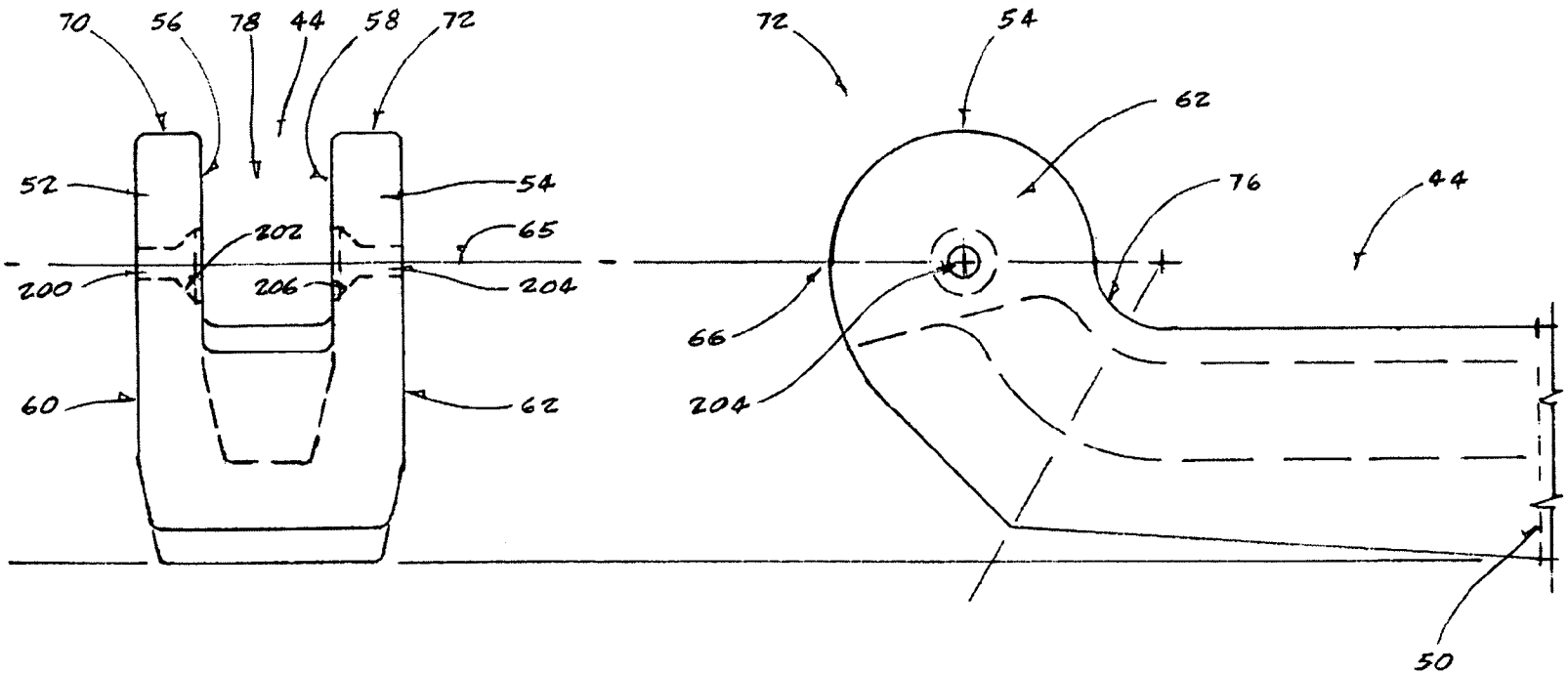
FIG. 4 is a front view and a side view of the front portion of our invention.

Referring now to FIG. 4, there is in a front sectional view and a side view the front portion (44) of the in line skate guard of our invention. Line (50) services to delineate the front portion (44) from the mid portion (46). It is to be understood that the line (50) demarcation may vary in location depending on the mold manufacturer but will generally be found in the location shown.

Still referring to FIG. 4, there is shown a front sectional view of front portion (44). The front portion (44) has opposite and parallel first (52) and second (54) lugs projecting upwards. The lugs are used to mount means to fix our invention to the in line skate as more fully explained below. The first (52) and second (54) lugs having inside surfaces (56) and (58) respectively and outside surfaces (60) and (62) respectively defining a front portion first width between them. The lugs have curved front surfaces (64) and (66). In another embodiment of the invention these front surfaces may be flat and vertical. Each of the lugs further has arcuate top surfaces (70) and (72) respectively and incurvate rear surfaces (74) and (76). The first (52) and second (54) lugs are opposed between gap (78). As the rollers of the in line skate are jammed into our in line skate guard, the walls of the skate guard flex outwards to receive the width of the rollers and then, once the rollers are inserted into the groove, the walls will compress or pinch against the sides of the rollers holding them immobile.

The Rear Portion

Figure 5:
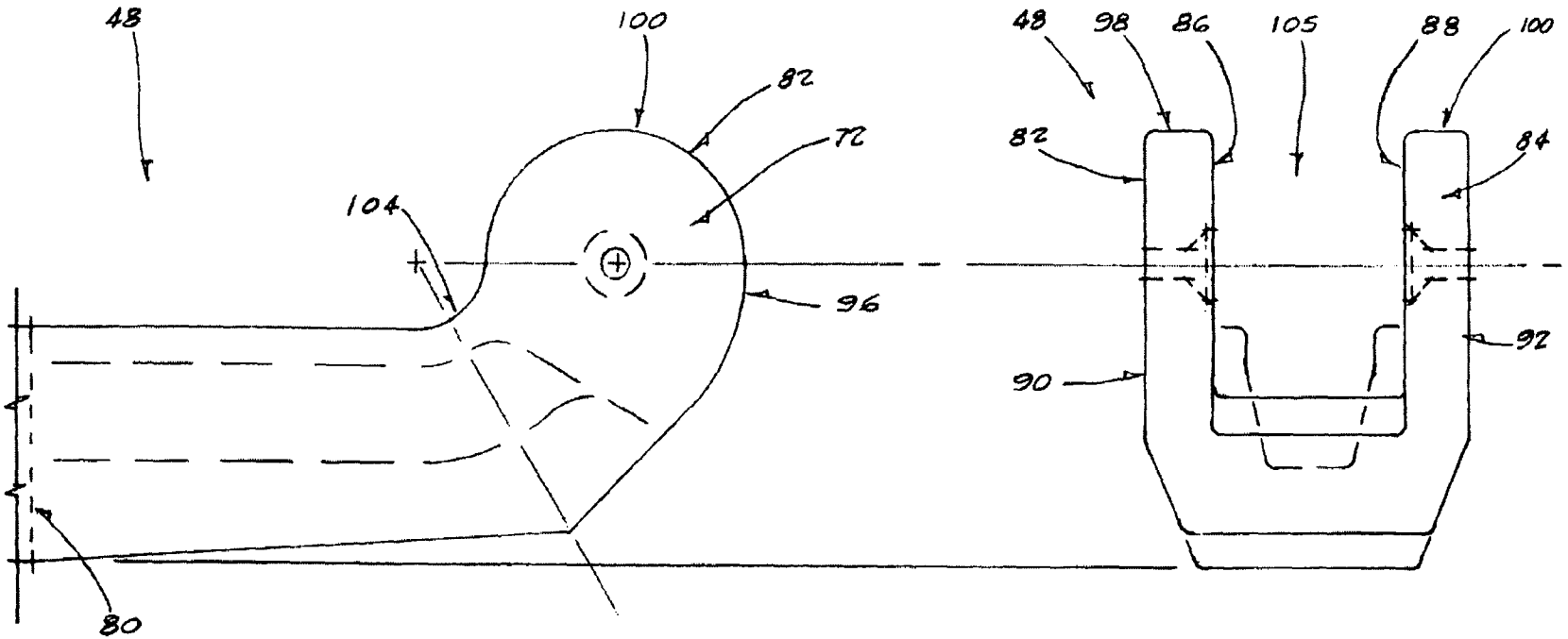
FIG. 5 is a side view and a rear view of the rear portion of our invention.

Referring now to FIG. 5, there is shown in side view and rear sectional view the rear portion (48) of our in line skate guard. Line (80) serves to delineate the rear portion (48) from the mid portion (46). It is to be understood that the line (80) demarcation may vary in location depending on the mold manufacturer but will generally be found in the location shown.

Figure 8:
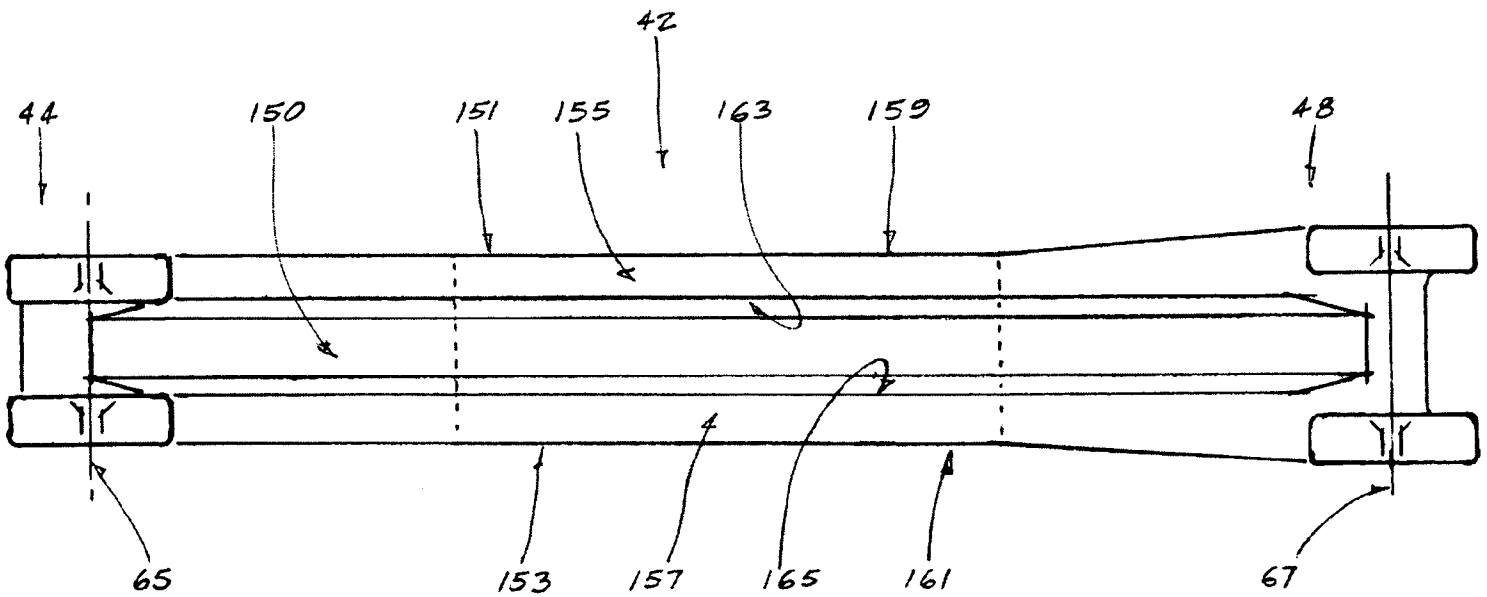
FIG. 8 is a top view of the elongate body of our invention.

Still referring to FIG. 5, there is shown a rear sectional view of rear portion (48). The rear portion (48) has opposite and parallel third (82) and fourth (84) lugs projecting upwards. The lugs are adapted to mount fixing means to fix our invention to the in line skate as more fully explained below. The third (82) and fourth (84) rear portion lugs having inside surfaces (86) and (88) respectively and outside surfaces (90) and (92) respectively defining a rear portion third width between them. The lugs have curved rear surfaces (94) and (96). In another embodiment of our invention, these surfaces may be flat vertical surfaces. Each of the lugs further has arcuate top surfaces (98) and (100) respectively and incurvate front surfaces (102) and (104). The rear portion third (82) and fourth (84) lugs are opposed between a gap (105). Gap (105) is adapted in width to receive brake spur (36). The third width of the rear portion (48) is slightly larger than the first width of front portion (44) in order to accommodate wider gap (105). This is illustrated in FIG. 8.

Figure 7:
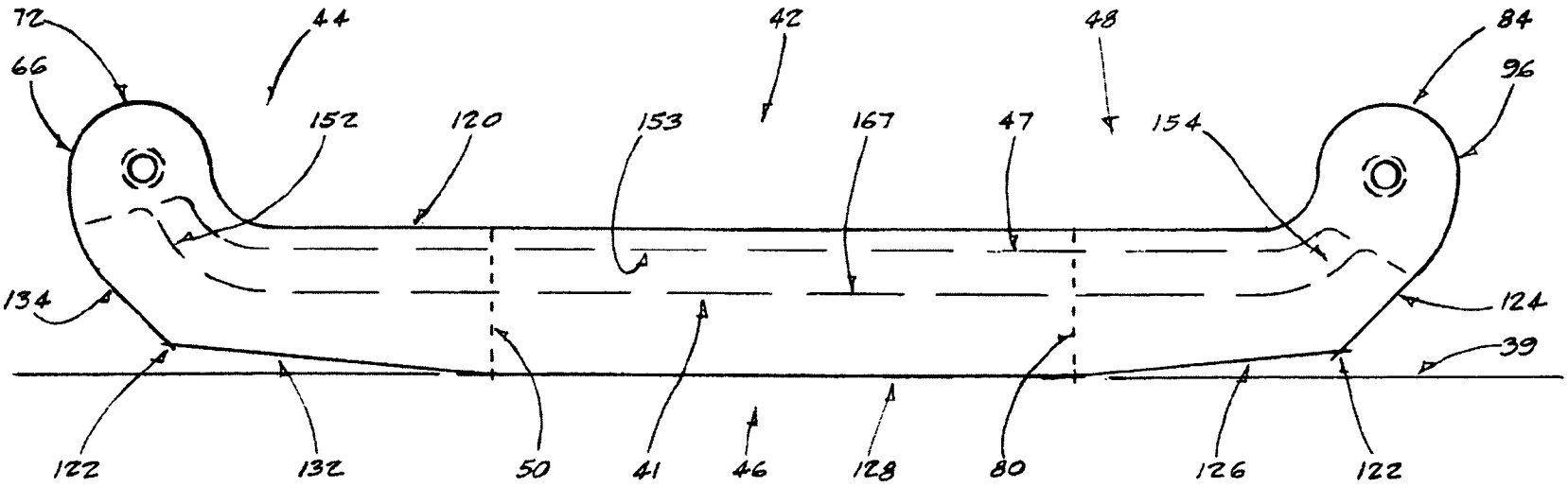
FIG. 7 is a side view of the elongate body of our invention.

Referring to FIG. 7, it can be seen that the curved contours of the lugs permit the wearer of the in line skate to jamb the rollers of the skate onto the stake guard from a variety of angles without having to resort to a toe-first insertion.

The Middle Portion

Figure 6:
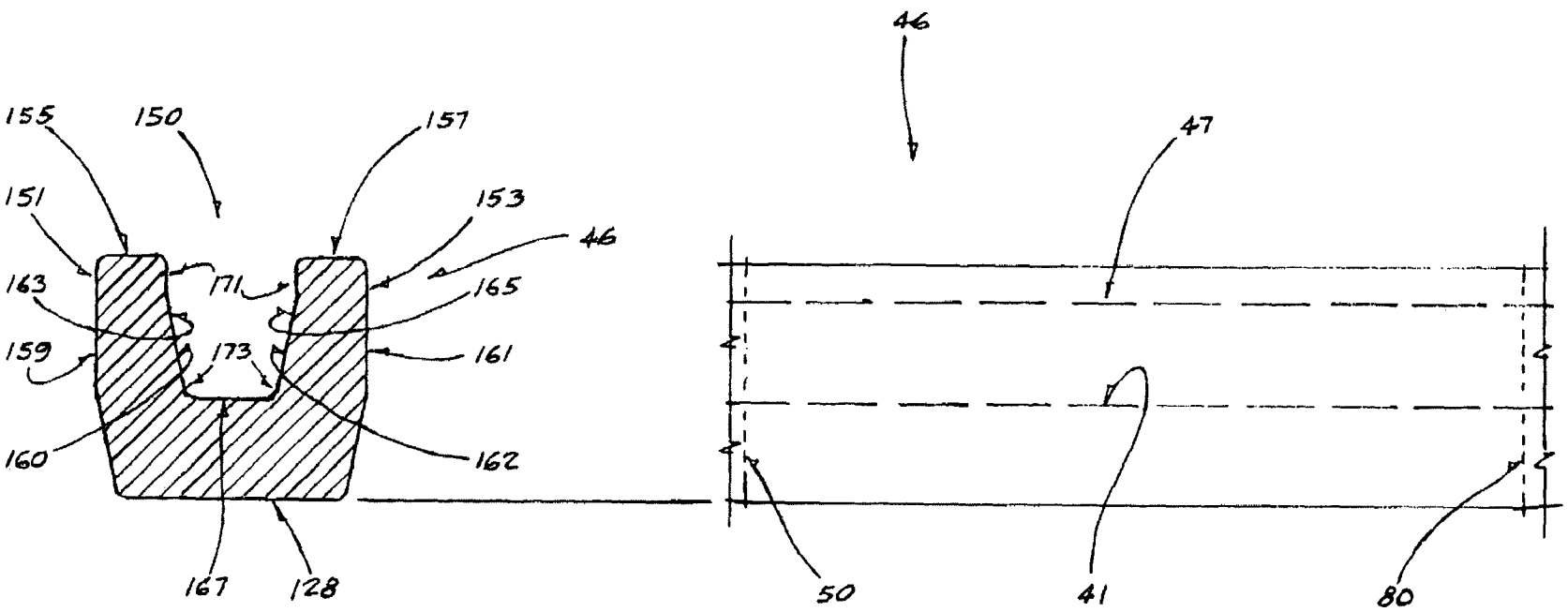
FIG. 6 is a side view and a cross-sectional view of the middle portion of our invention.

Now referring to FIG. 6, there is shown the middle portion (46) of the elongate body of our invention in side view and in cross section. Middle portion (46) has a second width defined between outside surfaces (159) and (161). Demarcation line (50) separating the front portion (44) from the middle portion (46) is shown as is demarcation line (80) separating the middle portion (46) from the rear portion (48). In the cross section view, there are shown the following features, some of which are more fully explained below. The middle portion (46) includes horizontal bottom portion (128) walls (151) and (153) defining groove (150). There is also illustrated the unique beveling of the inside of the groove (150). The top groove first width (171) is adapted to accommodate the width of the rollers of the in line skate and to create a compressive or pinching relationship between the inside surfaces of the walls (163) and (165) and the side walls of rollers. Deeper within the groove are found bevels (160) and (162) that create a thinner groove second width (173) at the bottom surface (167) of the groove. The beveled portions within our in line skate guard are adapted to accommodate the rounded rolling surface of the rollers. When the skate is placed within the skate guard the lower beveled portion of the groove will pinch against the sides of the rounded rolling surface of the rollers. As the rounded rolling surface of the roller wears down with use the pinching action of the beveled portion continues to accommodate roller wear over time and holds the rollers immobile regardless of their wear. Advantageously, the harder the skate guard is used the more secure the skate guard is on the in line skate. For example, the wearer of our skate guard may run while wearing in line skates with our invention attached. As the wearer runs, the rollers are forced deeply within the groove and thereby further immobilizing the rollers.

Still referring to FIG. 6, the side view of the middle portion (46), line (41) represents the depth of the groove and line (47) represents the top of the beveled portion (162).

The Elongate Body

Now referring to FIG. 7, there is shown in side view, the elongate body (42) of our invention comprising a front portion (44), a mid portion (46) and a rear portion (48). The elongate body has a horizontal top surface (120).

The Bottom Walking Surface

Still referring to FIG. 7, there is shown one inventive feature of our invention, namely, the beveled bottom surface (122) extending from the front surfaces (64) and (66) to the vertical rear surfaces (94) and (96). The beveled bottom surface may further include various tread patterns to improve the purchase or traction of the beveled bottom surface on a walking surface. The bottom surface (122) has five integral contact planes in a serial and contiguous relationship. From back to front, these planes are number (124), (126), (128), (132) and (134). These contact planes are adapted for contact with a walking surface (39) and have a profile adapted to accommodate the human walking gait cycle. Each plane is further adapted to permit the entirety of the bottom surface (122) to gain purchase or traction as the wearer walks. As previously discussed, the human walking gait cycle comprises the heel strike phase; then proceeding to a transition phase between the heel strike phase and the flat foot phase; the foot flat phase; then a transition phase between the flat foot phase and the heel off phase; the heel off phase; and, a toe off phase. The rear first contact plane (124) is adapted to contact the walking surface during the heel strike phase. The rear contact plane (124) is raised approximately 45 degrees from the horizontal. The second contact plane (126) is adapted to contact the walking surface during the transition between the heel strike phase and the foot flat phase. The second contact surface (126) is forward of the first contact surface and raised slightly above the horizontal. The second contact surface represents approximately 20% of the bottom surface (122) of the elongate body. The third contact surface (128) is horizontal and represents about 40% of the bottom surface of the elongate body. The third contact surface (128) is adapted to contact the walking surface and bear the wearer's weight in a stable manner during the foot flat phase of the walking gait cycle. The fourth contact surface (132) is ahead of the third contact surface (128) and is raised slightly from the horizontal. The fourth contact surface represents about 20% of the bottom surface and is adapted to contact the walking surface during the heel off phase of the human walking gait cycle. The fifth contact surface (134) is ahead of the fourth contact surface and is raised at an angle of approximately 45% from the horizontal. The fifth contact surface (134) is adapted to contact the walking surface during the toe off phase of the walking gait cycle. It is to be understood by a person skilled in the art of the invention that these diagrams and the above description represent the preferred embodiment of our invention. Other embodiments of our invention may exist that have variations to the angles and lengths of contact surfaces described above. However, all embodiments of our invention are adapted to accommodate the natural human walking gait cycle.

Figure 7A:
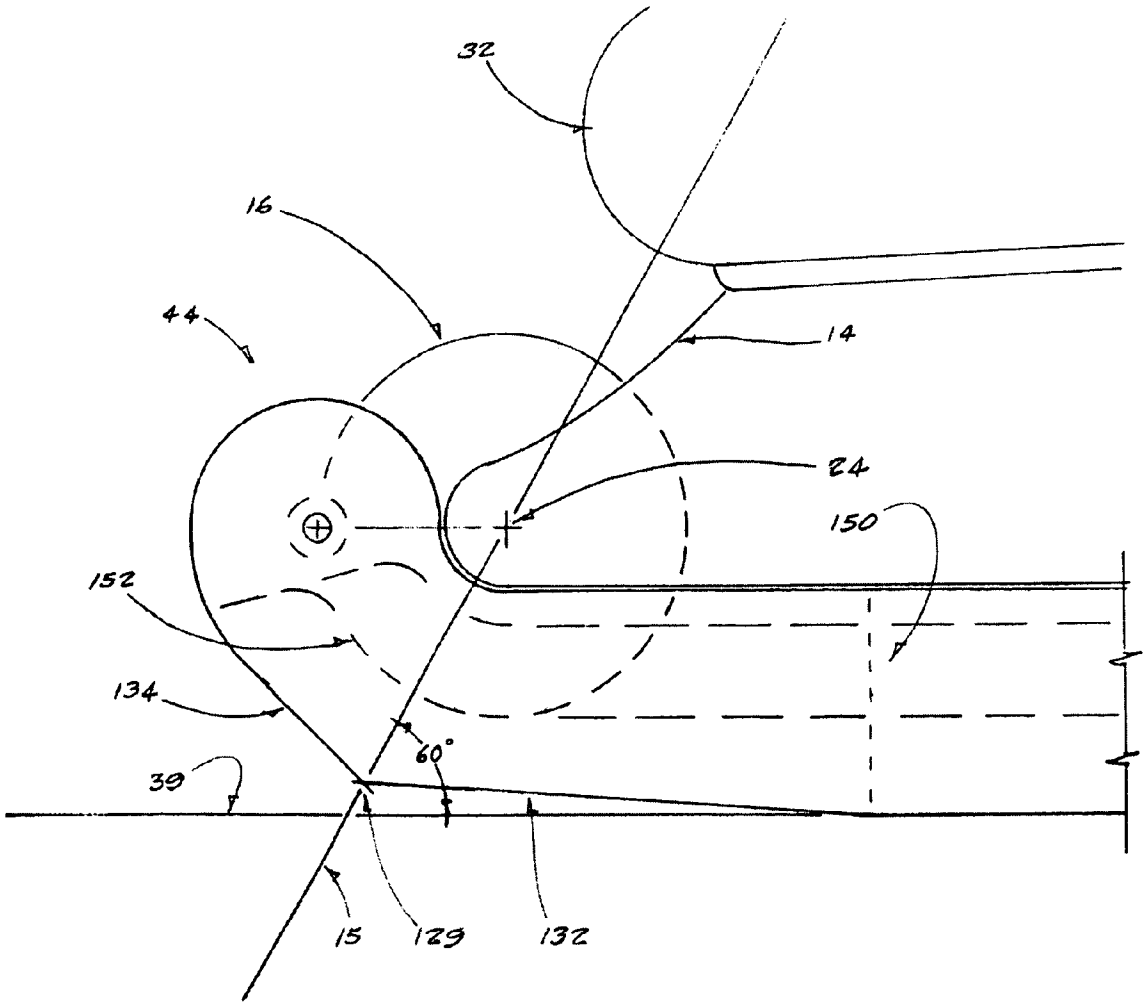
FIG. 7A is a side view of the front portion of our invention showing the angular relationship between the toe, the first roller wheel axle and the contact surface.
Figure 7B:
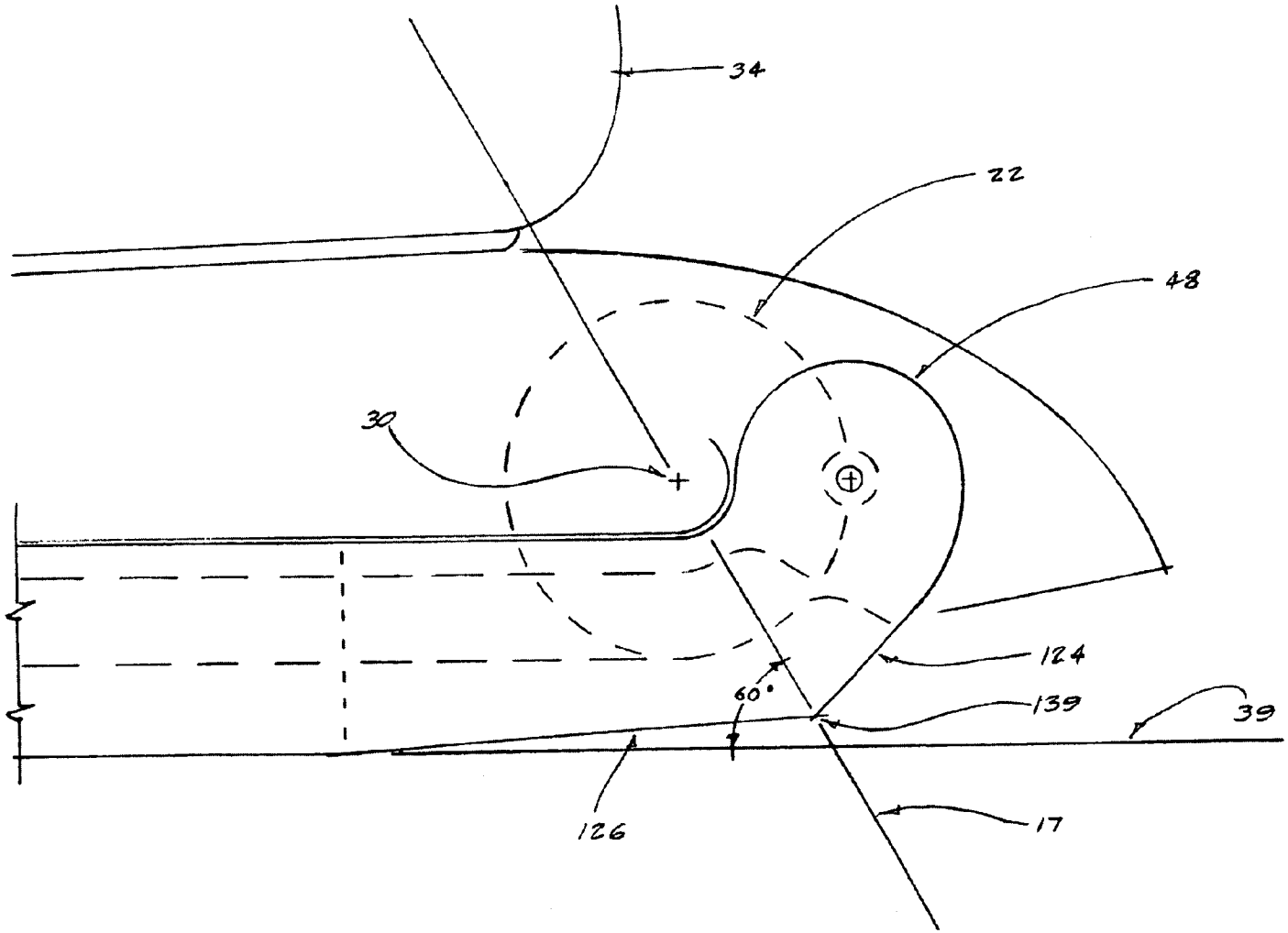
FIG. 7B is a side view of the rear portion of our invention showing the angular relationship between the heel, the last roller axle and the contact surface.

Referring to FIG. 7A, there is shown the front portion of the in line skate guard with an in line skate installed. Front roller (16) is shown inserted within the groove (150) and bight (152). The junction (129) between contact surface (134) having a purchase angle of 45 degrees and contact surface (132) is shown in alignment with the axis (24) of roller (16) and the toe (32) of the skate boot by line (15). This line creates an angle of 60 degrees. This angle is an optimum angle of the preferred embodiment of the invention and facilitates the use of a natural walking gate by the wearer. Similarly, FIG. 7B illustrates a similar alignment between the heel (34) of the skate boot, the axle (30) of the rear roller (22) and the junction (139) between contact surface (126) and contact surface (124). This angle is also optimized to 60 degrees to facilitate the natural walking gate.

The Upper Surface of the Elongate Body

Another important feature of our invention which represents an improvement over the prior art is the manner in which our in line skate guard immobilizes the rollers of an in line skate within the elongate body (42) of our invention against movement and provides stability thereby permitting a natural walking and even running while wearing the in line skate guard of our invention.

Referring now to FIGS. 6, 7 and 8, there is shown our invention elongate body (42) in a side and top view respectively, with means within the body for accepting, immobilizing and securing the plurality of rollers of an in line roller skate. As shown in FIG. 8, there is a channel-shaped groove (150) depending from the upper surface (120) of the body (42) into the body to a depth illustrated by line (41) adequate to retain the plurality of rollers in a stable and immobile configuration. As illustrated in the cross section in FIG. 6, the channel shaped groove is defined by side walls (151) and (153). Each of the walls (151) and (153) includes an upper surface (155) and (157), inside surfaces (163) and (165) and outside surfaces (159) and (161). Groove first width (171) and groove second width (173) of the channel-shaped groove (150) are also shown. Between the groove first and groove second widths there are bevel transition portions (160) and (162). The groove first width is wide enough to accept the entire width of the roller in a pinching engagement. It is understood that the material used to mold the elongate body has a certain amount of elastic flexibility that will allow the walls (151) and (153) to flex elastically outwardly when the roller blades are pushed into the groove (150). The beveled portion created by the groove second width is adapted to accept the rounded rolling surface of the roller also in a pinching engagement. The use of two widths and beveled portion in the groove permits the roller to embed further into the elongate body as the wearer walks or runs. Furthermore, as the rollers wear, the groove is able to adapt and continue to hold the worn roller in a pinching engagement. This provides provide greater stability to the wearer of our in line skate guard as the rollers wear down over time. As illustrated in FIG. 3, when the skate rollers are placed into the skate guard, the bottom surface (11) of frame (14) of the skate will be in an abutting contact with the upper surfaces (155) and (157) of the skate guard walls (151) and (153).

Referring to FIG. 7 and FIG. 8, groove (150) commences at the front portion (44) at axis (65) and terminates at the rear portion (48) at a point that is slightly forward of axis (67). The groove (150) has a front curvilinear portion or bight (152) that curves front wards and upwards from the horizontal to accommodate the shape of the first roller of the in line skate. The groove also has a rear curvilinear portion or bight (154) that curves upwards and backwards to accommodate the shape of the rear roller of the in line skate.

Figure 9:
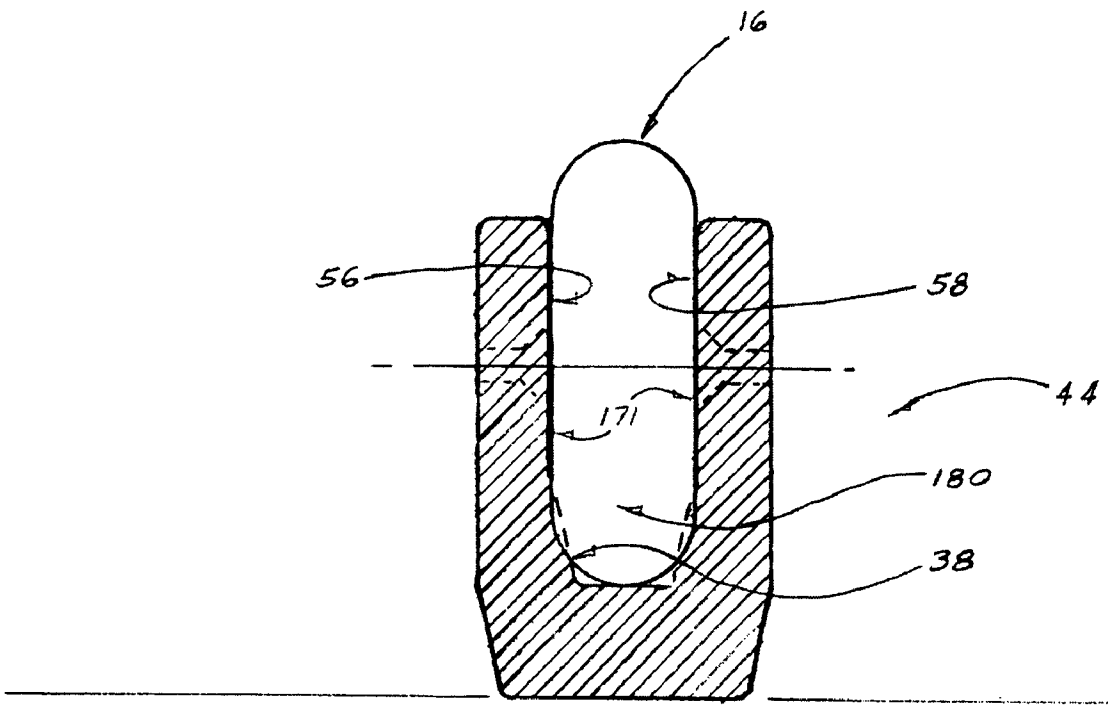
FIG. 9 is a sectional view of the front face of the front portion of our invention showing the first roller of an in line skate installed therein.

Referring to FIG. 9 there is shown in sectional view the front face of front portion (44) with first roller (16) held within the elongate body. The first roller wheel body is placed within the groove first width (171) and the rounded rolling surface of the roller wheel body is placed within the groove beveled portion. The lower contact surface of the roller is in contact with the bottom of the groove.

Figure 10:
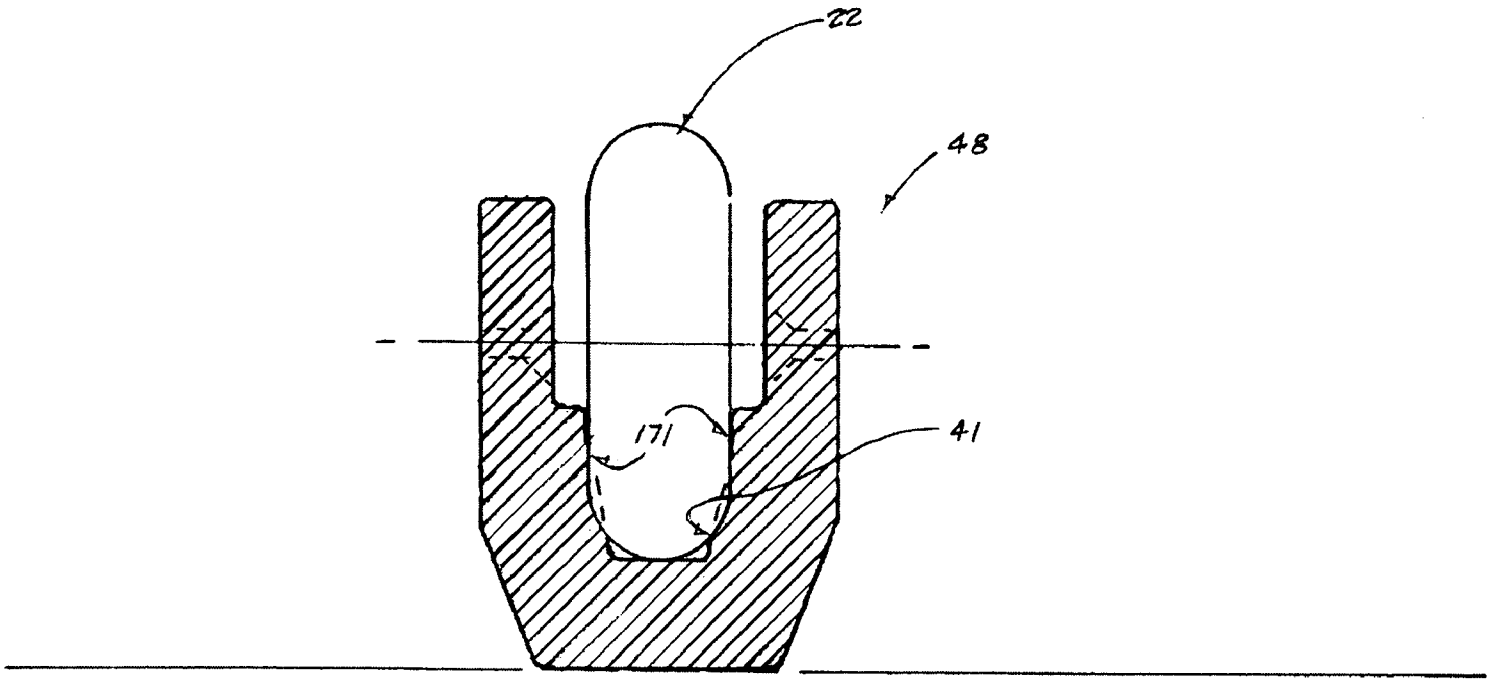
FIG. 10 is a sectional view of the rear face of the rear portion of our invention showing the last roller of an in line skate installed therein.

Referring to FIG. 10, there is shown the back face of the back portion (48) in section view. The rear roller (22) of the in line skate is placed within the groove first width (171) in a pinching engagement to prevent rotation of the roller. The rounded rolling surface (41) of the last wheel body (22) is placed in a pinching relationship within the beveled portion of the groove. The bottom of the wheel is in contact with the bottom of the groove.

Fastening Our in Line Skate Guard to the in Line Skate

Figure 11:
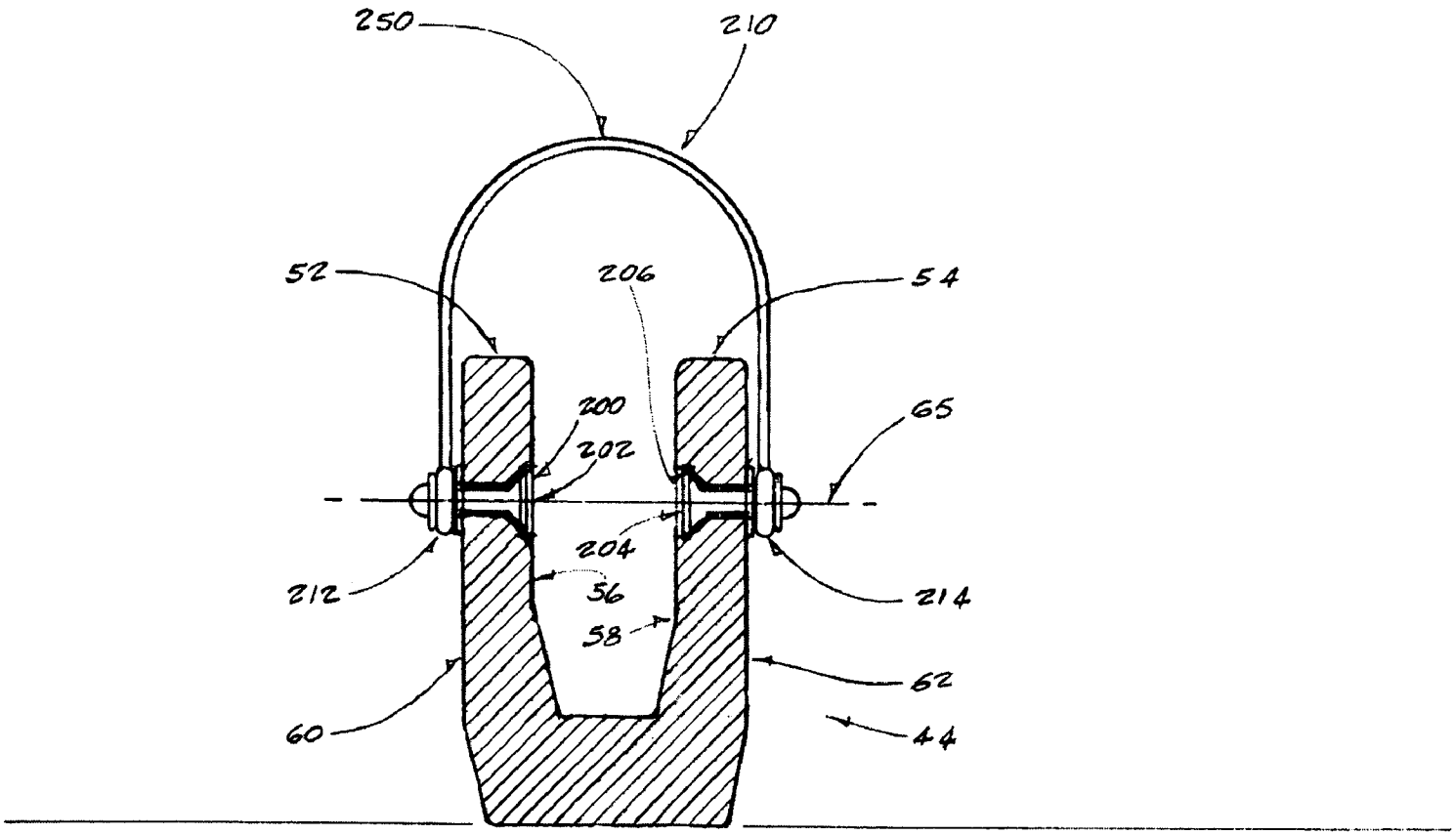
FIG. 11 is a sectional view of the front portion of our invention showing first fixing means.

We will now describe the means to fasten our in line skate guard elongate body to the in line skate. Referring to FIG. 11, there is shown the front face of the front portion (44) in sectional view. There is a first aperture (200) having an axis (65) located in the centre of the front portion first lug (52). The first aperture penetrates from the outside surface (60) of the front portion first lug (52) to the inside surface (56) of the front portion first lug. The aperture has a countersunk portion (202) on the inside surface (56) of the front portion first lug. There is also a second aperture (204) located in the centre of the front portion second lug (54) co-axial with the first aperture (200). The second aperture (204) penetrates from the outside surface (62) of the front portion second lug to the inside surface (58) of the front portion second lug. The second aperture has a countersunk portion (206) on the inside surface. Also included as part of fixing means is a first semi-circular pivot hoop (210) having a length terminating in a first (212) and second loop (214). The first semi-circular pivot hoop is fixed by fixing means described in more detail below between the front portion first lug (52) and the front portion second lug (54).

Figure 12:
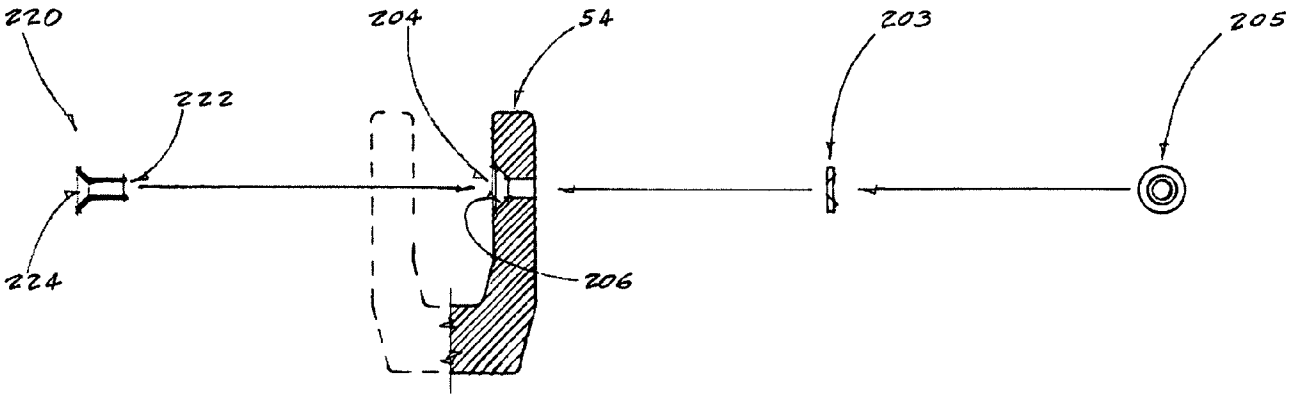
FIG. 12 is a cross sectional view of the front portion of our invention illustrating the installation of sleeves into the apertures on each of the four lugs of our invention.

Referring to FIG. 12, there is shown a cross sectional view of the first portion emphasizing the second lug (54). FIG. 12 illustrates the installing of second sleeve (220) in second aperture (204). Each of the first, second, third and fourth apertures described herein have sleeves installed in a similar fashion. The sleeve has the function of preventing excessive deformation to its respective aperture.

Second sleeve (220) is located within the front portion second lug (54) aperture (204). The second sleeve (220) has a first end (222) and a second end (224). The second sleeve second end (224) is adapted in shape to conform to the countersunk portion (206) of the front second lug aperture (204). Each of the sleeves is configured in such a manner that the outside edge of each of the second ends of the sleeves are recessed slightly from the inside surfaces of each of the lugs. In this way, the sleeve does not contact the side walls of the rollers and abrade them. Each of the flange washer (side view at 203) is placed over end (222) of the sleeve to act as a friction bearing surface for loop (214). The flange washer is shown in face view at (205).

Figure 13:
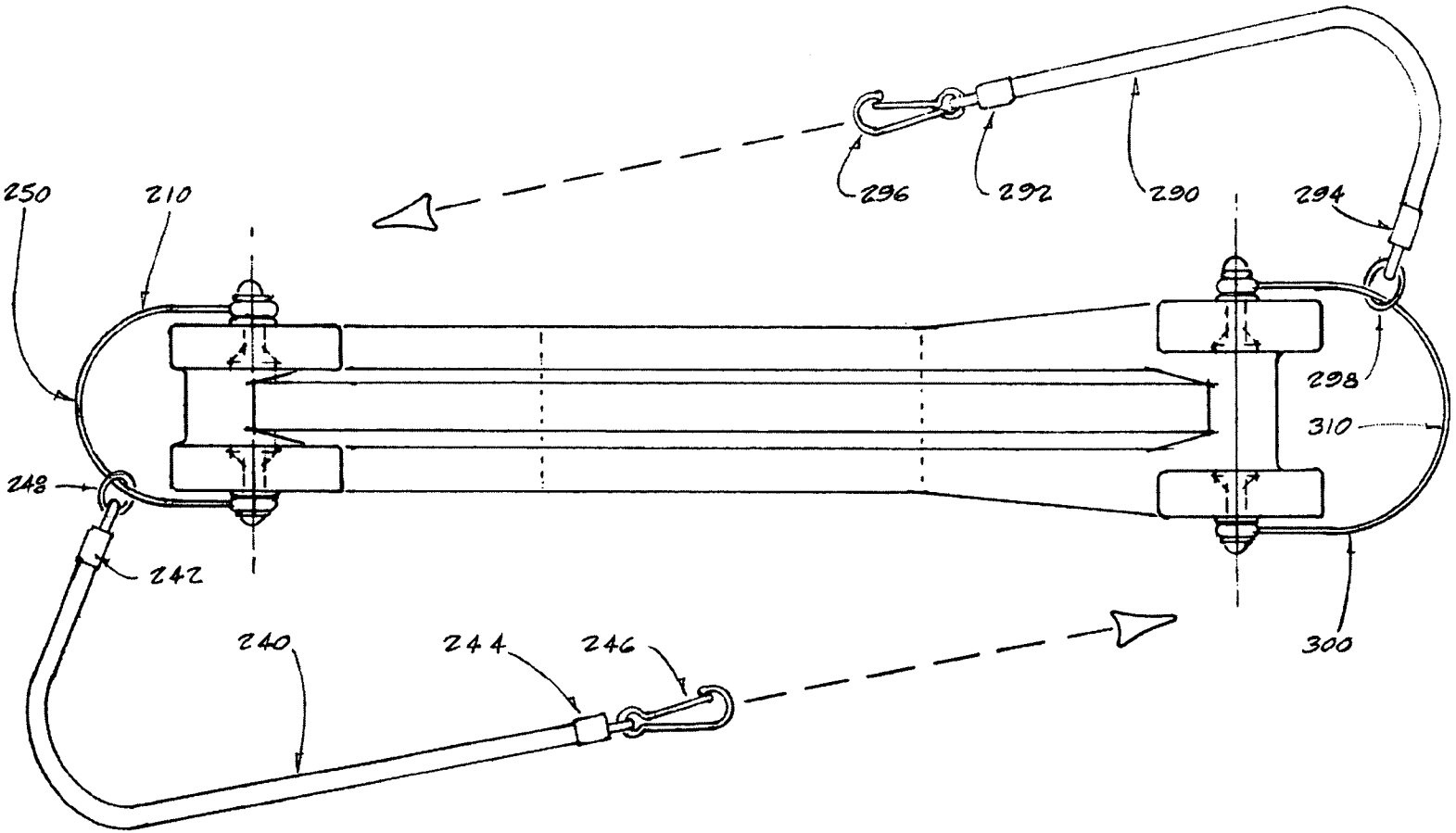
FIG. 13 is a top view of our invention showing the relationship between the elongate body and the fixing means.

Referring to FIG. 13, fixing means also includes a first tension chord (240) having a first end (242) and a second end (244). Fixed to the second end of the tension chord is a clip (246) and fixed to the first end of the tension chord is an eye ring (248). The eye ring (248) is engaged in a sliding relationship with the first pivot hoop (210).

Referring back to FIG. 3 and to FIG. 13, the semi-circular first pivot ring (210) has a radius sufficient to permit the apex (250) of the first semi-circular pivot ring to situate on top of the first roller (16). As well, the first tension chord (240) is sufficiently dimensioned to permit engagement of the first clip (246) to the second semi-circular pivot hoop (300).

Figure 14:
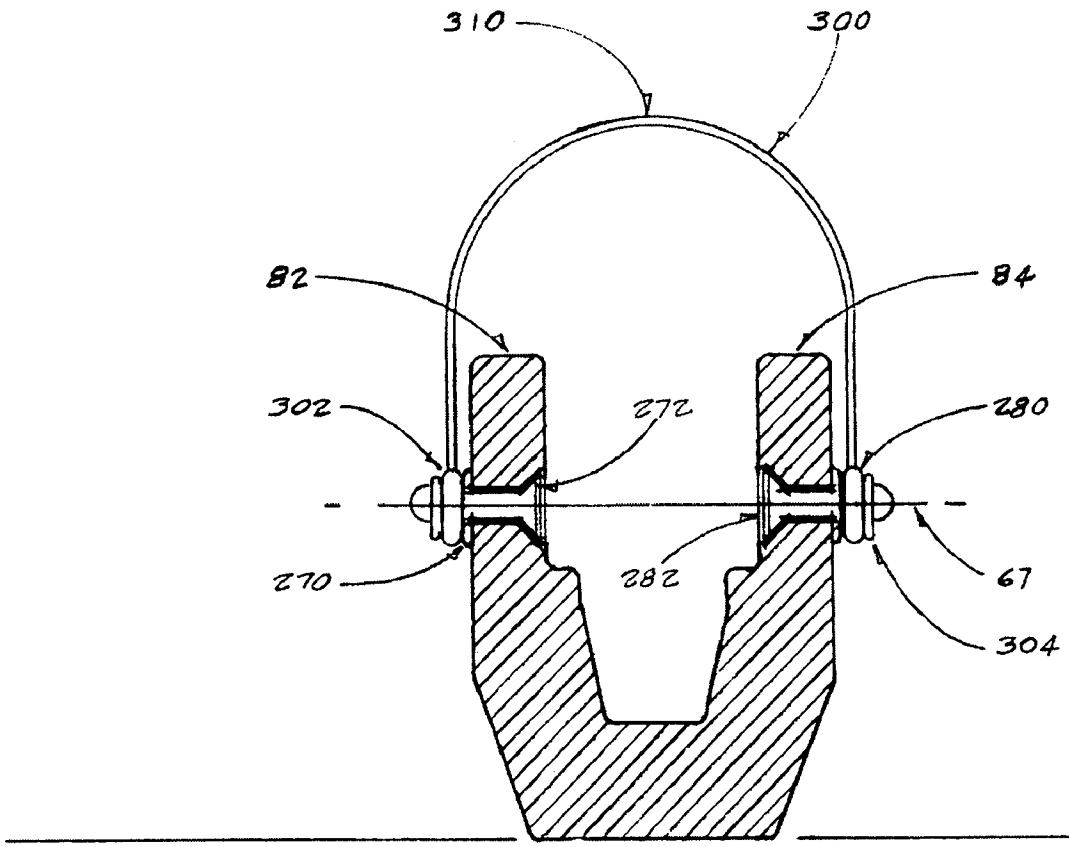
FIG. 14 is a sectional view of the rear portion of our invention illustrating second fixing means.

Referring now to FIG. 14, there is shown second fixing means comprising a third aperture (272) having an axis (67) in which is located a third sleeve (270). The third sleeve has a first end and a second end (276). The second end (276) is adapted in shape to conform to the countersunk portion of the rear lug third aperture (272). There is also a fourth sleeve located within the fourth lug fourth aperture co-axial with the third aperture (272). The fourth sleeve has a first end and a second end. The fourth sleeve second end has a countersunk portion conforming to the countersunk portion of the fourth aperture.

Referring back to FIG. 12, the manner in which these sleeves are installed is illustrated. Also included as part of the second fixing means is a second semi-circular pivot hoop (300) having a length terminating in a first (302) and second loop (304). The second semi-circular pivot hoop is fixed by fixing means between the front portion third lug (82) and said rear portion fourth lug (84).

Referring back to FIG. 13, there is also included in second fixing means a second tension chord (290) having a first end (292) and a second end (294). Fixed to the first end of the second tension chord is a second clip (296) and fixed to the second end of the second tension chord is a second eye ring (298). The second eye ring (298) is engaged in a sliding relationship with the second pivot ring (300).

Referring back to FIG. 3, the second pivot ring (300) has a radius sufficient to permit the apex (310) of the second pivot ring to situate on top of the fourth roller (22). As well, the second tension chord (290) is sufficiently dimensioned to permit engagement of the second clip (296) to the first semi circular pivot hoop (210).

Figure 15:
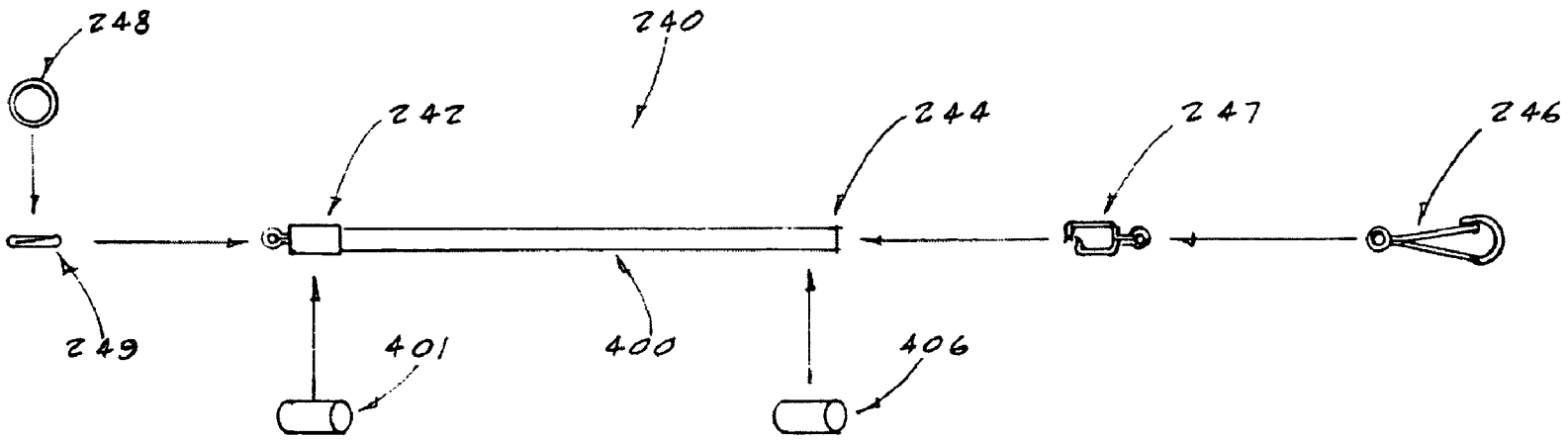
FIG. 15 is an expanded assembly drawing of one of the tension chords used in our invention.

Referring now to FIG. 15, there is shown additional detail of the tension chord (240). Tension chord (240) and (290) are identical and therefore this figure serves to illustrate both. Chord (240) consists of an elastic member portion (400), a first end (242) and a second end (244). The first and second ends of the chord are covered with a plastic sleeve (404) and (406) respectively. These act to protect the ends of the chords from abrasion. The sleeves also act to anchor eye ring (248) and eye ring mount (249) to the tension chord first end (242) and clip mount (247) fixed to the tension chord second end (242). The tension chords are long enough and thick enough to permit engagement of the clips to their opposite hoops as illustrated in FIG. 13. As well, the tension chords are sufficiently dimensioned to be able to wrap around the body of an average in line skater so that the tension chords can be joined to hold our in line skate guards.

Figure 16:
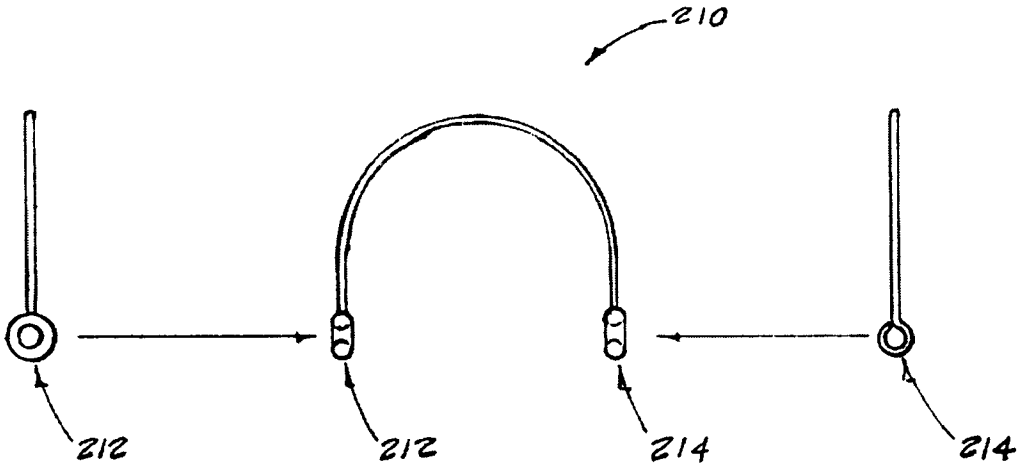
FIG. 16 is a detailed view of the first pivot hoop of our invention.

Referring now of FIG. 16, there is shown details of the first (210) semi circular pivot hoop. The first hoop (210) and the second hoop (300) are identical and therefore this Figure will serve to illustrate both. The pivot hoop (210) is preferably made from piano wire and has two loops (212) and (214).

Figure 17:
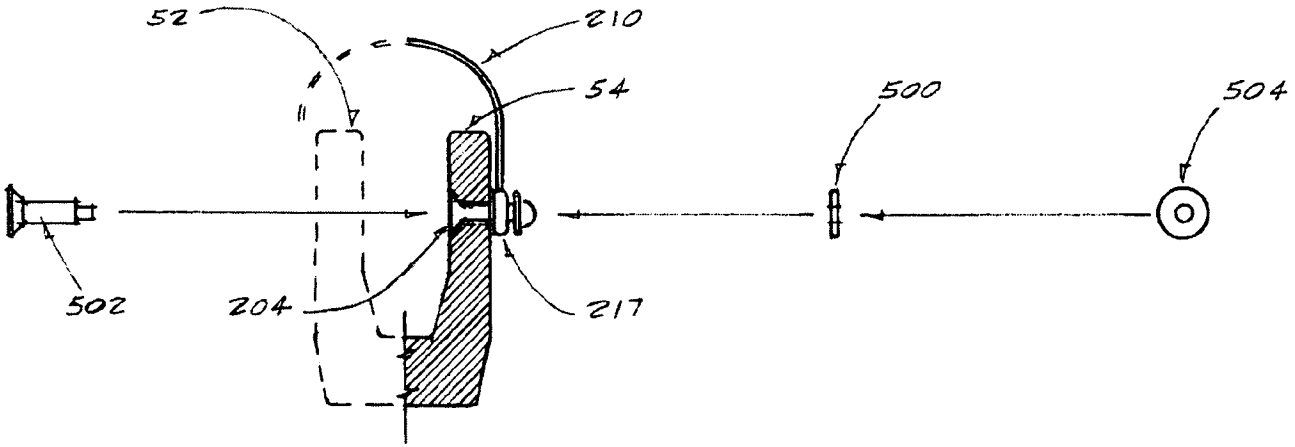
FIG. 17 is a sectional view of the front portion of our invention showing detail on how the first semi circular pivot hoop is fixed to the first portion.

Referring now to FIG. 17, there is shown detail on how the first (210) semi circular pivot hoop is fixed to the front (44) portion lugs (52) and (54). First hoop (210) is illustrated here and it is understood that the second hoop (300) is fastened in the same manner. The hoop (210) loop (214) is placed over the aperture (204) as shown. The aperture has a sleeve (206) inserted in it. The sleeve is countersunk to avoid abrasion against the outside surface of the in line skate roller. A shaft (502) is inserted into the sleeve. The shaft has a head configured to match the countersunk portion of the sleeve and a stepped down opposite end. The shaft is fixed in place inside the sleeve with glue. The opposite stepped down end of the shaft protrudes slightly from the outside surface of the lug. A countersunk washer (500) is placed over the stepped down end of the shaft flush with the outside surface of the lug. A washer side view is shown at (504). The washer acts as a bearing surface for loop (214). Loop (214) is placed over the shaft end. A second washer is placed over the stepped down end of the shaft after the loop. A button head rivet is then formed onto the second washer with the stepped down end of the shaft. In this way the loop is free to pivot around the shaft between the first and second washers. The pivot hoop will have constant freedom and will not loosen or tighten and the rivet will not fall off.

As understood by a person skilled in the art, all of the hardware associated with our invention, such as the rivets, sleeves and pivot rings, is made from suitable strong, durable and rust-resistant metals such as stainless steel, brass or chrome metal.

Although this description contains much specificity, these should not be construed as limiting the scope of the invention by merely providing illustrations of some of the embodiment of the invention. Thus the scope of the invention should be determined by the appended claims and their legal equivalents rather than by the examples given.

What is claimed is:

1. An in line skate guard for an in line skate, said in line skate comprising a boot and a frame having a bottom surface and adapted for carrying a plurality of serially mounted rollers, said plurality of serially mounted rollers including a first roller and a last roller, wherein each of said plurality of rollers has a width and a rounded rolling surface adapted for contacting a contact surface, and wherein the in line skate includes a brake spur, said in line skate guard comprising an elongate body comprising:

a. a horizontal upper surface having a groove along the length thereof, said groove having a first width and a transitional bevel to a second width narrower than said first width wherein the groove is adapted for receiving and holding the plurality of serially mounted rollers in a pinching relationship thereby preventing their rotation;

b. a beveled bottom contacting surface comprising a plurality of contact planes for contacting a walking surface, wherein said elongate body is composed of:

c. a front portion having:

i. a first width;

ii. opposite and parallel first and second lugs projecting upwards; and, iii. a front bottom surface adapted for purchase on said walking surface;

d. a middle portion contiguous with said front portion and having:

i. a second width equal to the first width;

ii. a groove comprising a groove first width, and a transitional bevel to a groove second width; and, iii. a middle bottom surface contiguous with said front bottom surface and adapted for purchase on the contact walking surface; and, e. a rear portion having:

i. a third width wider than said first width;

ii. opposite and parallel third and fourth lugs projecting upwards; and, iii. a rear bottom surface contiguous with said middle bottom surface and adapted for purchase on the walking surface.

2. The in line skate guard as claimed in claim 1 wherein:

a. said front bottom surface comprises a first contact plane having an angle of approximately 45 degrees to the contact surface; and, a second contact plane having a slightly elevated angle above the contact surface wherein said second contact plane equals approximately 20 percent of said beveled bottom contacting surface;

b. said middle bottom contact surface comprises a third horizontal contact plane wherein said third horizontal contact plane equals approximately 40 percent of the beveled bottom contacting surface; and, c. said rear bottom surface comprises a fourth contact plane having a slightly elevated angle above the walking surface; and, a fifth contact plane having an angle of approximately 45 degrees to the walking surface, wherein said fourth contact plane equals approximately 20 percent of the beveled bottom contacting surface.

3. The in line skate guard as claimed in claim 2 wherein said first and second opposite and parallel lugs define a first front gap between them, and wherein said first front gap is adapted to accept said width of said first roller.

4. The in line skate guard as claimed in claim 3 wherein said third and fourth opposite and parallel lugs define a second rear gap said rear gap adapted in width to receive said brake spur.

5. The in line skate guard as claimed in claim 4, wherein the groove is further defined by:

a. a first wall having a top surface, an inside surface and an outside surface; and, b. a second wall having a top surface, an inside surface and an outside surface;

wherein said first wall and said second wall are adapted to flex outwards when the plurality of serially mounted rollers are inserted between them and in consequence hold the plurality of serially mounted rollers within the groove in a pinching relationship.

6. The in line skate guard as claimed in claim 5, wherein the groove further includes:

a. a bottom surface adapted to engage the rounded rolling surface of each of the plurality of serially mounted rollers in a supporting relationship;

b. wherein the groove first width is adapted to receive and hold said roller width in a pinching relationship, and;

c. wherein said transitional bevel is adapted to receive and hold the rounded rolling surface of each of the plurality of serially mounted rollers in a pinching relationship.

7. The in line skate guard as claimed in claim 6, wherein the groove further includes:

a. a front curvilinear bight curving front wards and upwards into the first front gap to conform to the first roller;

b. a rear curvilinear bight curving rearwards and upwards into said rear gap to conform to the last roller; and, c. a depth so that when the in line skate guard is fastened to the in line skate, the top surfaces of the first wall and the second walls respectively abut against the bottom surface of the frame.

8. The in line skate guard as claimed in claim 7 further comprising means for securing the elongate body to the plurality of serially mounted rollers, said means comprising:

a. in the front portion:

i. a first aperture in the first lug;

ii. a second aperture in the second lug;

wherein said first and second apertures include a countersunk portion on the inside walls of the first and second lugs respectively;

b. in the rear portion:

i. a third aperture in the third lug;

ii. a fourth aperture in the fourth lug;

wherein said third and fourth aperture include a countersunk portion on the inside walls of the third and fourth lugs respectively;

c. a first semi-circular pivot hoop having a first apex, said first semi circular pivot hoop mounted between the first lug and the second lug by first mounting means; and, d. a second semi-circular pivot hoop having a second apex, said second semi circular pivot hoop mounted between the third lug and the fourth lug by second mounting means.

9. The in line skate guard as claimed in claim 8 wherein said semi circular first pivot hoop has a radius sufficient to permit said first apex to situate on top of the first roller.

10. The in line skate guard as claimed in claim 9 wherein said semi circular second pivot hoop has a radius sufficient to permit said second apex to situate on top of the in line skate brake spur, and where the in line skate brake spur is absent, said semi circular second pivot hoop has a radius sufficient to permit said second apex to situate on top of the in line skate last roller.

11. The in line skate as claimed in claim 10, wherein said first mounting means comprises a first and a second sleeve disposed into the first lug aperture and second lug apertures respectively, wherein each of the first and second sleeves include a first end and a second end, said first and second sleeves' second end adapted in shape to conform to the countersunk portion of the first and second lug apertures, the first and second sleeve second ends slightly recessed in the first and second aperture inside end.

12. The in line skate as claimed in claim 11, said second mounting means comprises a third and a fourth sleeve disposed within the rear portion third and fourth lug apertures respectively, wherein each of the third and fourth sleeves includes a first end and a second end wherein said third and fourth sleeves' second ends are adapted in shape to conform to the countersunk portion of the third and fourth lug apertures, the first and second sleeve ends of the third and fourth sleeves slightly recessed in the aperture inside end.

13. The in line skate guard as claimed in claim 12, wherein said means for securing the elongate body to the plurality of rollers further comprises:

a. a first and a second tension cord, wherein each of said first and second tension cords have:

i. a first relaxed length less than the length of the elongate body;

ii. a second stretched length less than the length of the elongate body;

iii. a first end fixed to which is an eye ring, wherein said first tension cord eye ring is engaged in a sliding relationship with the first semi circular pivot hoop and wherein said second tension cord eye ring is engaged in a sliding relationship with the second semi circular pivot hoop;

iv. a second end fixed to which is a clip, wherein said first tension cord clip is adapted for releasable engagement with the second semi circular hoop and wherein said second tension cord clip is adapted for releasable engagement with the first semi circular hoop;

so that when the first and second clips are engaged with their respective first and second semi-circular hoops, the first and second tension cord assume their second stretched lengths.

14. The in line skate guard as claimed in claim 13 wherein the first tension cord and said second tension cord have identical construction.

15. The in line skate as claimed in claim 14 wherein the first and the second semi circular pivot hoops are fabricated from piano wire.

* * * * *